US006807695B1

(12) United States Patent
Barr

(10) Patent No.: US 6,807,695 B1
(45) Date of Patent: Oct. 26, 2004

(54) MATERNITY PATIENT SUPPORT

(75) Inventor: Jason L. Barr, Lawton, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/440,571

(22) Filed: May 19, 2003

(51) Int. Cl.[7] ..... A61G 7/075
(52) U.S. Cl. ..... 5/602; 5/662
(58) Field of Search ..... 5/602, 663, 428, 5/429, 430

(56) References Cited

U.S. PATENT DOCUMENTS

| | | | | |
|---|---|---|---|---|
| 1,440,571 A | * | 1/1923 | Lester et al. | 220/62.17 |
| 5,060,327 A | | 10/1991 | Celestina et al. | 5/662 |
| 6,427,269 B1 | | 8/2002 | Feddema | 5/602 |
| 6,564,405 B1 | | 5/2003 | Barr et al. | 5/662 |

* cited by examiner

*Primary Examiner*—Alexander Grosz
(74) *Attorney, Agent, or Firm*—Flynn, Thiel, Boutell & Tanis, P.C.

(57) ABSTRACT

A labor grip mechanism on each side of a main frame of a birthing bed, each labor grip mechanism having a post with a free end and a hand grip mounted on the free end. A first mounting construction is provided for slidably supporting each post for simultaneous movement between a first position wherein the hand grip is stowed underneath the patient support and a second position wherein the hand grip is oriented wholly out from underneath the patient support. A second mounting construction is provided for supporting each post for simultaneous rotational movement between the second position wherein the hand grip is also oriented in a plane beneath the plane of the patient support and a third position wherein the hand grip is oriented in a plane above the plane of the patient support. A hand grip positioning device is provided for facilitating the rotational movement only when the posts are in the aforesaid second or third position.

3 Claims, 4 Drawing Sheets

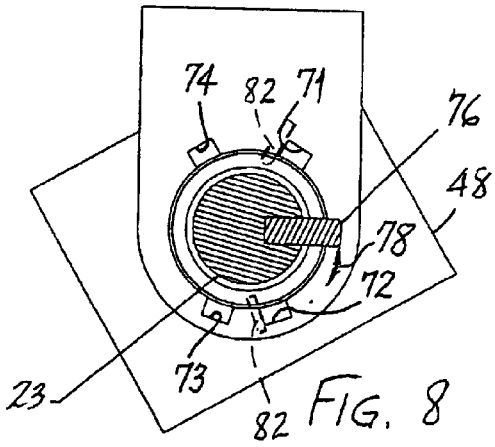
FIG. 8
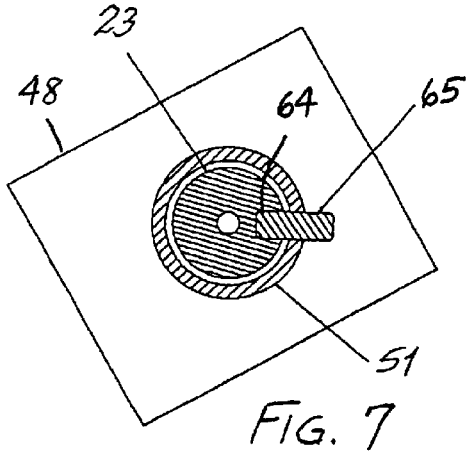
FIG. 7
FIG. 6
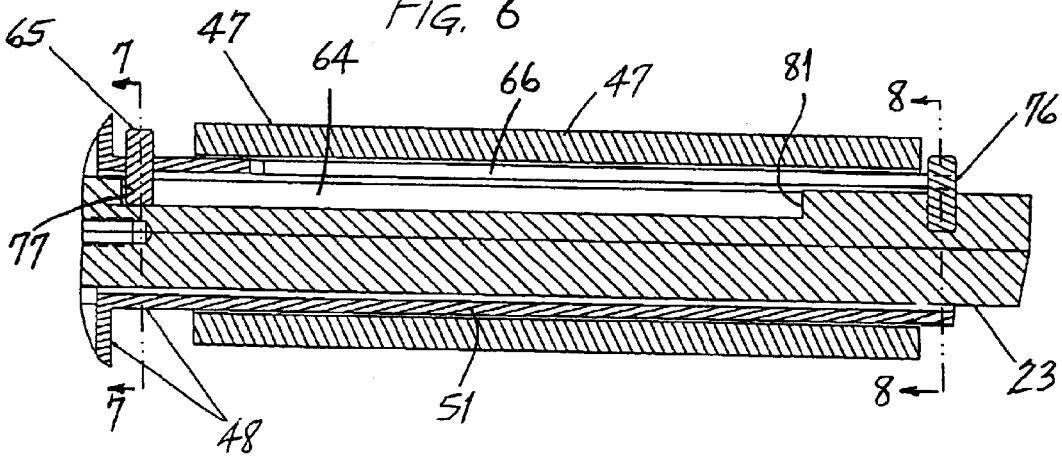

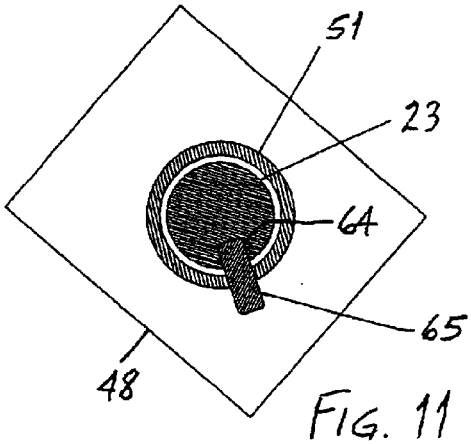
FIG. 11
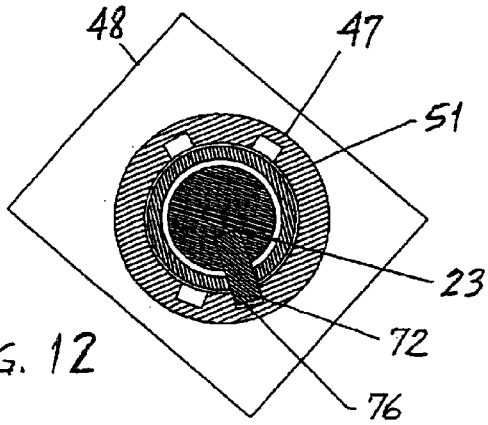
FIG. 12
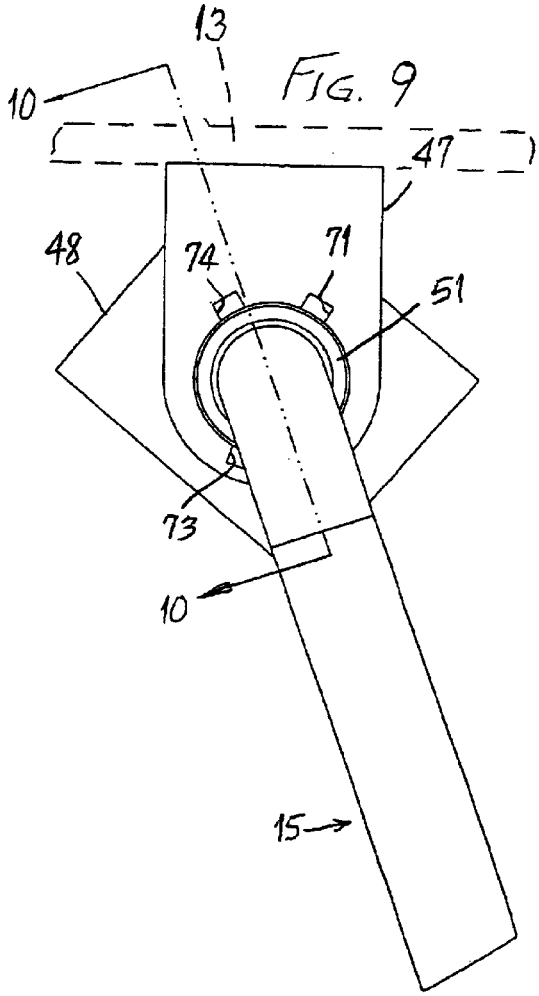
FIG. 9
FIG. 10
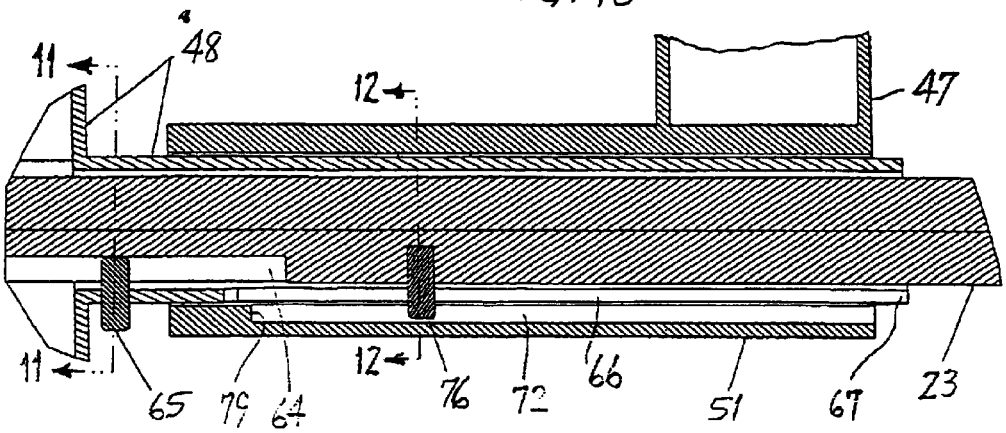

MATERNITY PATIENT SUPPORT

FIELD OF THE INVENTION

This invention relates to a birthing bed and, more particularly, to a birthing bed equipped with a labor grip mechanism on each side of the bed to assist the mother in creating maximum thrust during the birthing process.

BACKGROUND OF THE INVENTION

It is widely known to provide labor grip mechanisms on a birthing bed to assist the mother in creating maximum thrust during the birthing process. U.S. Pat. Nos. 5,060,327, 6,427,269 and 6,564,405 are cited as three exemplary forms of a labor grip mechanism on a birthing bed. The disclosures in U.S. Pat. Nos. 6,427,269 and 6,564,405 owned by the same Assignee that owns the present invention are incorporated herein by reference. It is desirable to simultaneously deploy the labor grip mechanism and to move the labor grip mechanism to a stowed position out of the way when they are not needed.

Accordingly, it is an object of this invention to provide a labor grip mechanism on both sides of a birthing bed and which are simultaneously movable between a stowed position beneath the patient support and an in-use position wherein the hand grip is oriented above the upper surface of the patient support.

It is a further object of this invention to provide a labor grip mechanism, as aforesaid, wherein the action required to effect a simultaneous deployment of both of the labor grip mechanisms is quick, simple and intuitive.

It is a further object of the invention to provide a labor grip mechanism, as aforesaid, which is durable, steady to the birthing mother thereby psychologically causing the birthing mother to apply strong forces thereto in creating the maximum thrust forces required to assist in the birthing process.

It is a further object of the invention to provide a labor grip mechanism, as aforesaid, wherein the entirety of the labor grip mechanism is stowable wholly beneath the patient support.

SUMMARY OF THE INVENTION

The objects and purposes of the invention are met by providing an improved labor grip mechanism on each side of a main frame of a birthing bed, each labor grip mechanism having a post with a free end and a hand grip mounted on the free end. A first mounting construction is provided for slidably supporting the posts for simultaneous movement between a first position wherein the hand grips are stowed underneath the patient support and a second position wherein the hand grips are oriented wholly out from underneath the patient support. A second mounting construction is provided for supporting the posts for simultaneous rotational movement between the second position wherein the hand grips are also oriented in a plane beneath the plane of the patient support and a third position wherein the hand grips are oriented in a plane above the plane of the patient support. A hand grip positioning device is provided for facilitating the simultaneous rotational movement only when the posts are in the aforesaid second or third positions.

BRIEF DESCRIPTION OF THE DRAWINGS

Other objects and purposes of this invention will be apparent to persons acquainted with labor grip mechanisms of this general type upon reading the following specification and inspecting the accompanying drawings, in which:

FIG. 6 is a sectional view like FIG. 3, but depicting the labor grip mechanism oriented intermediate the deployed and stowed positions;

FIG. 7 is a sectional view taken along the line 7—7 of FIG. 6;

FIG. 8 is a sectional view taken along the line 8—8 of FIG. 6;

FIG. 9 is an end view of the labor grip mechanism in the stowed position;

FIG. 10 is a sectional view taken along the line 10—10 of FIG. 9;

FIG. 11 is a sectional view taken along the line 11—11 of FIG. 10; and FIG. 12 is a sectional view taken along the line 12—12 of FIG. 10.

DETAILED DESCRIPTION

Figure 1:
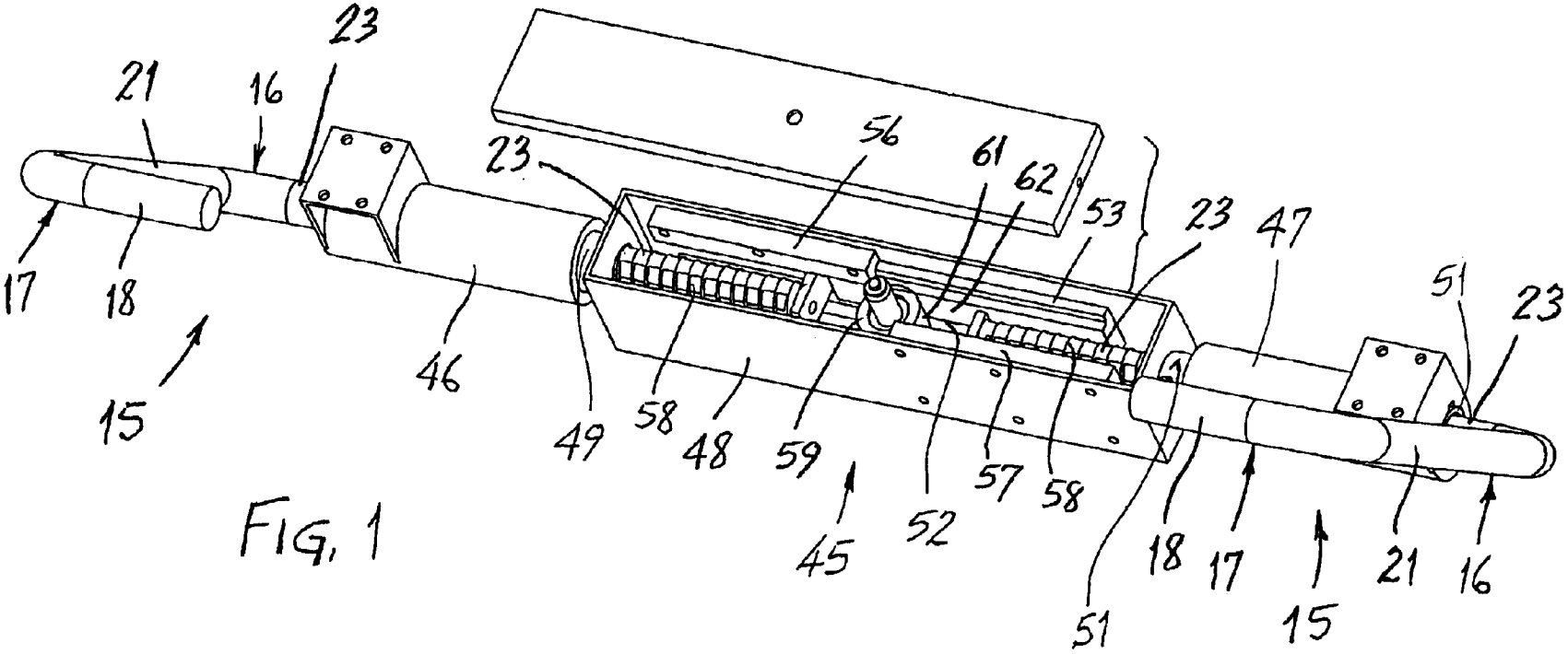
FIG. 1 is an isometric view of a rack and pinion mechanism for providing simultaneous movement of the labor grips.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

Figure 2:
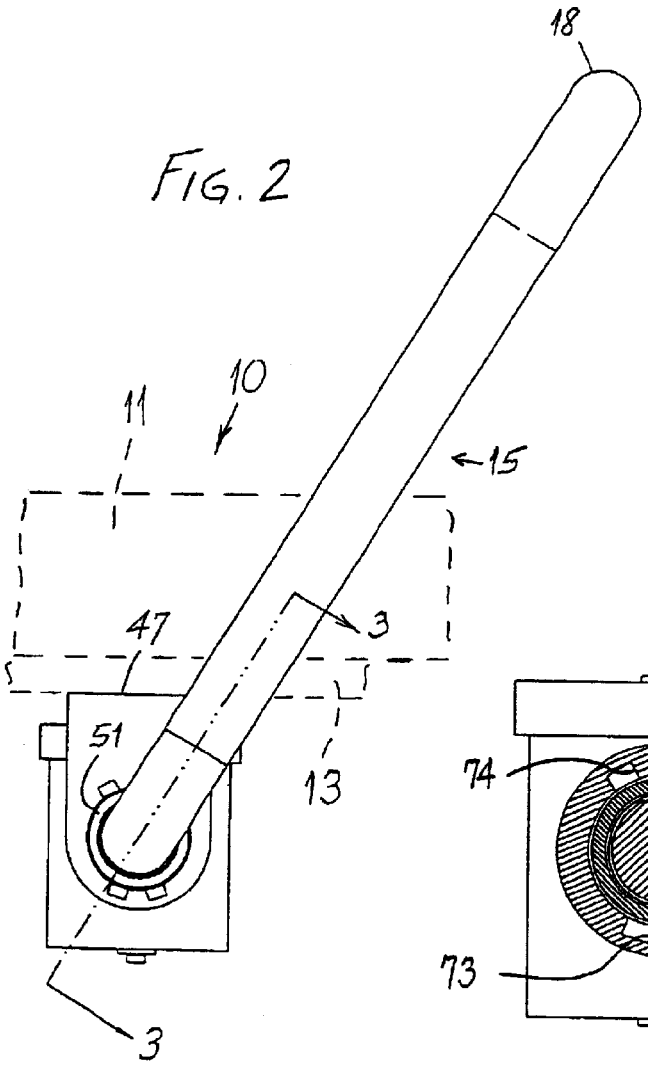
FIG. 2 is an end view of the labor grip mechanism in the deployed position.
Figure 4:
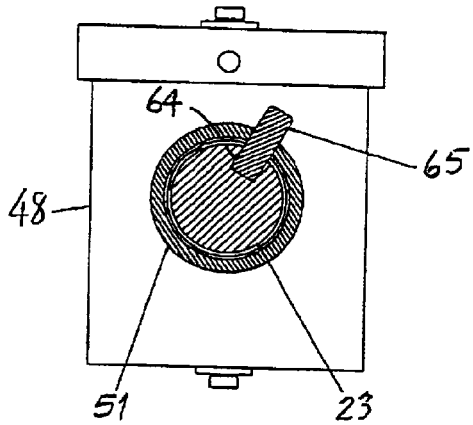
FIG. 4 is a sectional view taken along the line 4—4 of FIG. 3.
Figure 5:
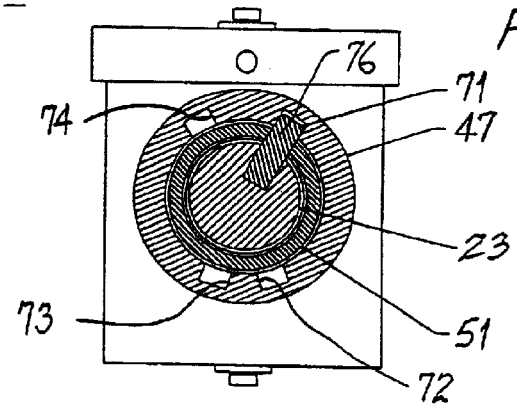
FIG. 5 is a sectional view taken along the line 5—5 of FIG. 3.

In the drawings, only a fragment of a birthing bed 10 has been illustrated in FIG. 2, namely, that part of the bed 10 having a mattress section 11 upon which the birthing mother sits with her legs extending beyond the right edge thereof. If desired, another mattress surface can be provided to the right of the mattress section 11 and therebelow so that the feet of the birthing mother can rest thereon.

The mattress section 11 is supported on a mattress frame 13 which in turn is elevatably supported on a main frame (not illustrated). The mechanism for elevating the mattress frame 13 up and down in relation to the main frame is well known in the art and, accordingly, a further detailed discussion thereof is believed unnecessary.

A labor grip mechanism 15 is mounted on both lateral sides of the main frame as shown in FIG. 1 and both labor grip mechanisms are the mirror image of each other and include a post 16 having a free end section 17 and a hand grip 18 mounted at the aforesaid free end 17. For purposes of simplifying this disclosure, only one labor grip mechanism is shown in the drawings and will be described in detail.

In this particular embodiment, the post 16 is an elongate rod-like member having a first section 23 and a second section 21 forming an angle therebetween. The handle 18 is a continuation of the rod-like member and is bent at a 90° angle with respect to the section 21. A protective member (not illustrated) is secured to the free end of the pipe section, namely, the handle 18.

A support mechanism 45 is provided for assisting the guiding of the straight section 23 between a first retracted position and a second extended position, particularly in order to stabilize the straight section 23 when it is in the second extended position. A spring 58 is embodied in the support mechanism 45 discussed in more detail below. As the straight section is transitioned between the first and second positions, the spring 58 will generate a return force urging the straight section 23 and, consequently, the labor grip mechanism to the first position of the labor grip mechanism. While the spring 58 is illustrated in FIG. 1 as a compression spring, it will be recognized by those of ordinary skill in the art that the straight section 23 can be configured to operate utilizing a tension spring.

Figure 3:
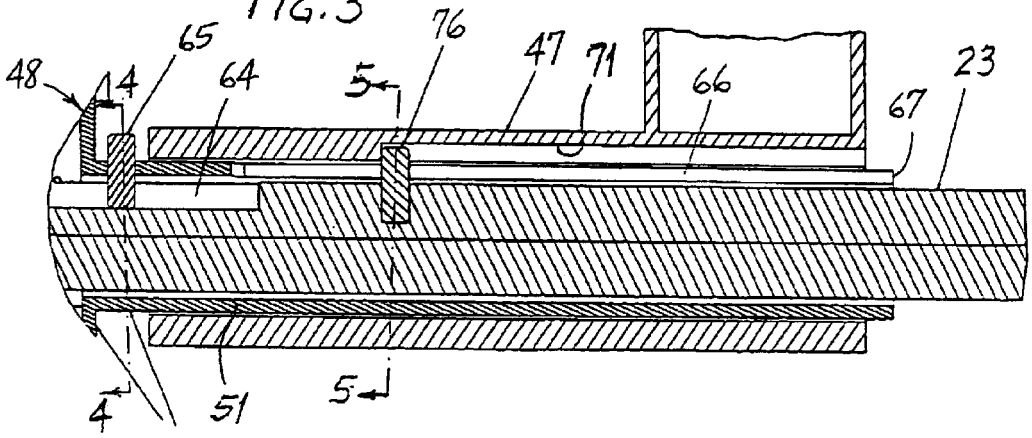
FIG. 3 is a sectional view taken along the line 3—3 of FIG. 2.

The support mechanism 45 includes a pair of axially spaced hollow bearing members 46 and 47 configured to be fastened to the underside of the mattress frame 13 as schematically represented in FIG. 2. An elongate housing 48 is provided which has a pair of axially elongate hollow axles 49 and 51 configured to be coaxially arranged within the holes in the bearing members 46 and 47. The straight sections 23 of each labor grip mechanism is axially slidably and rotatively received in and supported by the hollow axles 49 and 51 as shown in FIGS. 2–12 and extend into the interior 52 of the housing. An elongate slot 64 (FIGS. 3, 6 and 10) is provided in each straight section 23 and a pin 65 is secured to each of the hollow axles 49 and 51 and projects into the interiors of the hollow axles and is received in each slot 64. Each hollow axle 49 and 51 have one elongate slot 66 therein closed at an end adjacent the housing 48 and open at the opposite end 67 (FIGS. 3, 6 and 10). A pair of toothed racks, only one rack 53 is shown in FIG. 1, are slidably supported in corresponding guides 56 and 57. Each rack 53 is secured to an end of the respective straight section 23 that terminates in the interior of the housing. A compression spring 58 encircles each straight section 23 and is oriented between spring abutments formed by each end wall of the housing 48 and the end of the straight section 23 whereat the toothed rack 53 is secured. The racks 53 are spaced from each other and a pinion gear 59 rotatably supported on the housing 48 is configured so that its teeth schematically illustrated at 61 matingly engage the teeth 62 of each rack. As a result, a pulling force applied to one labor grip mechanism 15 to effect a movement thereof from a first stowed position to the second extended position will cause the driven rack to rotatively drive the pinion gear 59 and cause a corresponding driven movement of the other rack to effect a corresponding and simultaneously occurring deploying movement of the other labor grip mechanism 15. The hollow axles 49 and 51 and the elongate housing 48 will simultaneously rotate with the straight sections 23 due to the pinned connection provided by the pins 65 between the second position to a deployed third position where the hand grips 18 are oriented above the upper surface of the mattress 11 as shown in FIG. 2 as well as vice versa.

I have provided a system of slots and pins slidable in the slots as depicted in FIGS. 2–12 to limit the rotative movements of the hand grips 18 between the stowed and deployed positions. More specifically, each of the axially extending holes through the two hollow bearing members 46 and 47 are configured with plural elongate slots, here four slots 71, 72, 73 and 74 (FIGS. 5, 8 and 12) extending parallel to each other and coextensively with the length of the bearing members 46 and 47. Only two of the four slots are used on each side of the birthing bed, such as the slots 71 and 72 depicted in FIGS. 5, 8 and 12. The provision of the four slots 71–74 facilitates use of a single bearing member structure for opposite sides of the birthing bed.

A pin 76 is secured to each straight section 23 and projects radially outwardly through the elongate slot 66 and into a selected one of the slots 71 and 72 or slots 73 and 74. On the side of the birthing bed illustrated in the drawings, corresponding to the left side of FIG. 1, the selected slot 71 corresponds to a locked in place deployed third position of the labor grip mechanism 15 as shown in FIGS. 2–5.

When it is desired to move the labor grip mechanism to the stowed position illustrated in FIG. 9, a post 16 on the one side of the bed is manually gripped by an attendant and pulled outwardly (rightwardly in FIG. 3) away from the bed against the force of the springs 58 to cause the straight section 23 to be moved rightwardly therewith until the pin 76 exits the slot 71 as depicted in FIG. 6. During this outward movement, the pin 65 is sliding in the slot 64. The outward movement is limited by the pin 65 engaging an end wall 77 (FIG. 6) of the slot 76. When the pin 76 has exited the slot 71, the labor grip mechanism 15 can be rotated in the directions indicated by the arrows 78 in FIG. 8. In this instance, it is assumed that the attendant desires to move the labor grip mechanism 15 clockwise from the FIG. 2 deployed position to the stowed position illustrated in FIGS. 9–12 whereat the pin 76 becomes oriented in alignment with the slot 72. Thereafter, the return spring force of the springs 58 will be sufficient to pull the straight sections 23 leftwardly to draw the pin 76 into the slot 77 until the pin 76 engages the end wall 79 of the slot 72 and/or the pin 65 abuts the end wall 81 of the slot 64.

A labor grip mechanism rotation limiter can if desired be provided to limit the rotation of the labor grip mechanisms 15 to specific positions corresponding to the locations whereat the pins 76 are aligned with the entry to a selected slot 71 or 72 and 73 or 74. The rotation limiter could be in the form of a pair of spaced pins or dowels 82 (FIG. 8) projecting axially from the bearing members 46 and 47 into the path of movement of the pin 76 when it is oriented in the FIG. 6 position.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a bed having a main frame and a patient support mounted on said main frame, and comprising:

first and second posts, each having a free end;

first mounting means for slidably supporting said posts for simultaneous movement between a first position wherein said free ends are stowed underneath said patient support and a second position wherein said free ends are oriented wholly out from underneath said patient support;

second mounting means for supporting said posts for simultaneous rotational movement between said second position wherein said free ends are also oriented in a plane beneath a plane of said patient support and a third position wherein said free ends are oriented in a plane above the plane of said patient support;

said first and second mounting means being provided on a translational device including a housing with support means being provided for supporting said housing for rotational movement to and between positions corresponding to said second and third positions, said posts being slidably supported on said housing for movement to and between positions corresponding to said first and second positions, said translational device being configured to be responsive to manual forces applied to one of said pair of posts to effect a movement to and between said first and said second and said third positions for implementing a corresponding simultaneous movement of the other of said posts, said translational device further including a pair of spaced parallel toothed racks each slidably mounted on said housing and to said posts and a rotatably supported gear on said housing oriented in the space between said toothed racks and matingly engaging the teeth on each said toothed rack so that a translational movement of one of said toothed racks and a respective one of said posts secured thereto will cause a corresponding and simultaneous translational movement of the other of said toothed racks and a respective other of said posts secured thereto;

free end positioning means for facilitating said simultaneous rotational movement only when said posts are in said second or third positions; wherein the improvement comprises:

said translational device further including a pair of elongate guides having a longitudinal axis that extends generally perpendicular to a longitudinal axis of said patient support, each of said posts including a straight section at an end thereof remote from said free end, said straight section being rotatably and axially slidingly received in a respective said elongate guide and supported for said movement thereon between said first and second positions and said second and third positions, said free end positioning means including at least one elongate first slot extending lengthwise of each of said straight sections and extending generally parallel to a longitudinal axis of each of said straight sections, and a pin secured to said elongate guides and projecting radially into said elongate first slot to interlink said posts and said straight sections for simultaneous relative axial movement; and said elongate guides being rotatably supported in bearing sleeves mounted on said bed, said bearing sleeves and said straight sections having operatively releasably connected connection means thereon for facilitating a coupling of said straight sections to said bearing sleeves to render said straight sections incapable of rotative movement relative to said bearing sleeves and an uncoupling of said straight sections and bearing sleeves to render said straight sections rotatable between said second and third positions.

2. The device according to claim 1, wherein said connection means includes an elongate second slot in each of said bearing sleeves that extends parallel to said lengthwise extension of said elongate first slot and a pin projecting radially from each of said straight sections and into a respective said second slot to render said straight sections incapable of rotative movement relative to said bearing sleeves in said first position of said posts and projecting radially to a position free of reception in said second slot to render said straight sections rotatable when said posts are in said second position.

3. The device according to claim 1, wherein said translational device includes a spring device for simultaneously continuously urging said posts toward said first position thereof.

* * * * *